US010125455B2

(12) United States Patent
Millward et al.

(10) Patent No.: US 10,125,455 B2
(45) Date of Patent: Nov. 13, 2018

(54) LONG LIFE CERMET COATED CREPING BLADE

(71) Applicant: VOESTALPINE PRECISION STRIP AB, Munkfors (SE)

(72) Inventors: Chris Millward, Forshaga (SE); Tuuli Kamppila, Karlstad (SE)

(73) Assignee: VOESTALPINE PRECISION STRIP AB, Munkfors (SE)

( * ) Notice: Subject to any disclaimer, the term of this patent is extended or adjusted under 35 U.S.C. 154(b) by 0 days.

(21) Appl. No.: 15/534,781

(22) PCT Filed: Dec. 10, 2015

(86) PCT No.: PCT/SE2015/051325

§ 371 (c)(1),
(2) Date: Jun. 9, 2017

(87) PCT Pub. No.: WO2016/093766

PCT Pub. Date: Jun. 16, 2016

(65) Prior Publication Data

US 2017/0342660 A1 Nov. 30, 2017

(30) Foreign Application Priority Data

Dec. 10, 2014 (EP) ..... 14197073

(51) Int. Cl.

| | |
|---|---|
| ***D21G 3/00*** | (2006.01) |
| ***B31F 1/14*** | (2006.01) |
| ***D21G 3/04*** | (2006.01) |
| ***C23C 4/04*** | (2006.01) |
| ***C23C 4/12*** | (2016.01) |
| *B31F 1/12* | (2006.01) |

(52) U.S. Cl.

CPC ..... *D21G 3/005* (2013.01); *B31F 1/145* (2013.01); *C23C 4/04* (2013.01); *C23C 4/12* (2013.01); *D21G 3/04* (2013.01); *B31F 1/126* (2013.01)

(58) Field of Classification Search

USPC ..... 162/281

See application file for complete search history.

(56) References Cited

U.S. PATENT DOCUMENTS

| | | | | |
|---|---|---|---|---|
| 4,124,737 | A * | 11/1978 | Wolfla | C09D 5/18 428/640 |
| 7,244,340 | B2 | 7/2007 | Laithier et al. | |
| 2007/0224350 | A1 | 9/2007 | Schuisky | |
| 2013/0071647 | A1 | 3/2013 | Mayr et al. | |

FOREIGN PATENT DOCUMENTS

| | | | |
|---|---|---|---|
| DE | 1202008001721 | A1 | 11/2009 |
| DE | 102013201740 | A1 | 4/2014 |
| JP | 2003225988 | A | 8/2003 |
| WO | 2007108757 | A1 | 9/2007 |

OTHER PUBLICATIONS

International Search Report dated Mar. 9, 2016, for International Patent Application No. PCT/SE2015/051325.

International Preliminary Report on Patentability dated Dec. 20, 2016, for International Patent Application No. PCT/SE2015/051325.

* cited by examiner

*Primary Examiner* — Mark Halpern

(74) *Attorney, Agent, or Firm* — Karceski IP Law, PLLC

(57) ABSTRACT

A blade for creping a paper web from a Yankee cylinder surface is made of a steel substrate having a thickness of 0.7 mm-2 mm. The steel substrate is covered by a cermet coating that forms a working edge adapted for contact with the surface and a web impact area upon which the web impacts during creping. The cermet coating includes chromium carbides and tungsten carbides in a nickel based metal matrix. The cermet coating has a porosity of <2 volume % and a hardness of >1100 $HV_{0.3}$.

18 Claims, No Drawings

LONG LIFE CERMET COATED CREPING BLADE

CROSS-REFERENCE TO RELATED APPLICATION(S)

This is a National Stage Entry into the United States Patent and Trademark Office from International PCT Patent Application No. PCT/SE2015/051325, having an international filing date of Dec. 10, 2015, and which claims priority to European Patent Application No. 14197073.1, filed Dec. 10, 2014, the entire contents of both of which are incorporated herein by reference.

TECHNICAL FIELD

The invention relates to a crêping doctor blade for manufacture of tissue and related paper products. The crêping doctor blade is made from a hardened steel strip that has its wear resistance enhanced by application of a thin cermet coating, using a Thermal Spray coating technique.

BACKGROUND OF THE INVENTION

In the paper industry, crêping doctor blades are used for the manufacture of tissue and other related paper products. Creping doctor blades may be made of different materials such as Carbon steel strip, tool steel strip, composites and polymers. In addition, different types of coating may be applied by Thermal Spray coating in order to reinforce the working edge of the crêping doctor blade such as described in U.S. Pat. No. 7,244,340 B2.

In many Tissue mills Ceramic coated blades are the chosen crêping doctor blades due to the fact that they have relatively high hardness and therefore wear resistance but also they can accommodate the high temperatures that result from operation in contact with a steam filled 'Yankee' cylinder. In addition, they are not susceptible to one of the major wear mechanisms that limits the useful life of steel blades i.e. adhesive wear. The service life of ceramic coated crêping doctor blades is longer than even the best hardened steel blades but is still not consistently as long as is required for modern efficient tissue mills. This can be due to limitations in the hardness that can be achieved with ceramic coatings and also by the relationship between hardness and toughness, where extremely hard coatings can be prone to chipping at the important working edge of the blade.

One further drawback of ceramic coated crêping doctor blades is the fact that they are usually deposited by a plasma spraying process and therefore need a soft bond coat such as Ni—Cr. During the life of the blade, as wear proceeds, this bond coat can become exposed on the surface upon which the web impacts during crêping, leading to the need to make adjustments to the machine set-up to maintain paper quality.

DISCLOSURE OF THE INVENTION

An object of the present invention is to provide a coated crêping doctor blade that gives longer service lives in tissue making applications than the existing ceramic coated crêping doctor blades due to the improved wear resistance and anti-chipping properties. A further object is to provide a coated crêping doctor blade that produces tissue with consistent paper quality with a minimal need for the machine operators to progressively modify the operating conditions.

The invention is defined in the claims.

DETAILED DESCRIPTION

Ceramic coated crêping doctor blades have achieved wide acceptance in the tissue making industry because they generally offer a good service life whilst being compatible with most Yankee cylinders. In related industries tungsten carbide coated blades have been preferred to ceramic coated blades due to their superior wear resistance. In tissue making, the use of tungsten carbide blades has been limited by fears of damage occurring to the Yankee cylinders. Additional concerns regarding the use of tungsten carbide coated blades in crêping applications relate to their capability to withstand the higher temperatures that need to be endured by a crêping doctor blade. Whilst tungsten carbide coatings perform well in applications where the primary degradation mechanisms are abrasive wear or slurry erosion, their performance in circumstances where adhesive wear is one of the primary wear mechanisms is not widely documented. Adhesive wear (micro-welding) is known to be the main wear mechanism for steel blades in contact with Yankee cylinders.

In an attempt to overcome the limited resistance of tungsten carbide to high temperatures, related alternative coating solutions were sought by the inventors. Surprisingly, a cermet coating was found that was quoted as having a maximum service temperature of 700° C. but still had a quoted hardness greater than of $HV_{0.3}$ 1000. Furthermore, the identified cermet coating had a relatively low volume of metallic matrix (between 15 and 20 vol. %), to minimise the risk of coating suffering from adhesive wear during extended contact with a Yankee cylinder.

Initial HVOF spray trials using the manufacturer's spray parameters for the powder detailed in this invention were successful in producing a dense coating (<2% porosity) with art unexpectedly high hardness in excess of $HV_{0.3}$ 1100. Furthermore, testing the adhesion and general toughness of the coating revealed that it overcame some of the limitations presented by ceramic coatings.

Further development of the spray parameters led to improvements in both porosity and hardness with no significant reduction in toughness. The hardness levels in the optimised coating were on average $HV_{0.3}$ 1250 and porosity was less than 1.5%. It was possible to grind the resulting coating in the geometry required for common crêping applications with a high degree of dimensional stability and no evidence of chipping at the working edge or anywhere else.

Analysis of the cermet coating by SEM/EDS revealed the following chemical composition:

| Element | Semi-Quantitative Composition of Coating (% by weight) |
|---|---|
| Co | 3 |
| Cr | 40 |
| C | 9 |
| Ni | 10 |
| Fe | 0.4 |
| W | 35 |

It should be noted that the SEM/EDS analysis is semi-quantitative and involves a certain inaccuracy, in particular for the light elements. The measured analysis for carbon is thus inaccurate and given for completeness only.

The cermet coating of this invention can be applied by any Thermal Spray coating process i.e. Plasma, HVOF or HVAF, or any combination of one or more of them. The optimum deposition method found for this coating was HVOF.

The particle size of the powder and the method of manufacturing of the powder play a significant role in achieving the low levels of porosity necessary to deliver the optimum hardness for this application.

The wear resistance and more importantly the effect of extended contact with a Yankee cylinder were assessed by carrying out trials on a small scale wear testing rig that was designed to simulate the crêping process. After extended contact the marks on the cylinder of the crêping simulator were of a level similar to the marks that occur after a similar length of exposure using a standard reference steel blade. These results gave the inventors the confidence to proceed to full tissue mill trials

EXAMPLES

Tissue Mill Trials

A series of five blades of this invention with a coating based on WOKA 7502 powder from Oerlicon Metco, were trialled at a tissue mill that routinely uses traditional Ceramic coated crêping doctor blades. The trial parameters were as follows:

| Parameter | Trial values |
|---|---|
| Paper grade | Bleached Virgin fibre 16.3 g/m$^2$ |
| Reel moisture SP | 6.0% |
| Furnish | 94% short fiber: 6% long fibre |
| Yankee speed | 1800 m/min |
| Reel speed | 1332 m/min |
| Creping ratio | 28% |
| Reel linear load | 8-9 MPa |
| Yankee steam pressure | 4.9 Bar |
| Condense heaters hood temperature | Wet: 399° C.<br>Dry: 399° C. |
| Blade pressure | 4 Bar |
| Blade stick-out | 26 mm |
| Blade contact angle | FS: 23.7°/DS: 23.3° |
| Vibration tendency | Lew & Steady (825-880 mg) |
| Chipping tendency | None |
| Chatter tendency | None |
| Spray bar pressure | 4 Bar |
| Spray temperature | 51° C. |

Vibration monitoring was used during the trial to establish the stability of the interaction between the blade and the Yankee cylinder. The continuous monitoring of the vibrations revealed excellent and consistent results throughout the blade life. The measured levels of vibration were marginally lower and more consistent when compared to previous ceramic coated blades, according to the mill staff. The vibration results indicate zero or insignificant chatter.

The paper quality of the produced tissue was tested and found to be within the acceptable range. After the initial fine tuning of the process on the first paper roll, only minor changes were made to the crepe ratio and MD/CD ratio during the trial to maintain this paper quality. The build-up of coating and paper on the backside of the blade appeared to be minimal for the life of the blade, lending to excellent creping results.

The first trial blade lasted for a period of time that corresponded to 153% of the average life of a ceramic coated crêping blade and 134% of the life of the ceramic coated crêping blade that was used immediately prior to the trial: The amount of sheet breaks during the trial were minimal and acceptable to the mill staff. The examination of the first trial blade on removal due to a sheet break that was unrelated to the blade performance, revealed that it would have been possible to use the blade for a further period of life.

Further trial blades performed in a similar manner to the first blade with service lives well in excess of expectations with acceptable paper quality and minimal evidence of vibrations.

The invention claimed is:

1. A blade for creping a paper web from a Yankee cylinder surface, said blade comprising: a steel substrate having a thickness of 0.7 mm-2 mm, wherein the steel substrate has a working edge adapted for contact with said surface and a web impact area upon which the web impacts during creping, at least the working edge is provided with a cermet coating, wherein the cermet coating comprises chromium carbides and tungsten carbides in a nickel based metal matrix and wherein the cermet coating has a porosity of <2 volume % and a hardness of >1100 $HV_{0.3}$.

2. The blade according to claim 1, wherein the cermet coating has a chromium carbide content that is higher than a content of tungsten carbide.

3. The blade according to claim 1, wherein the cermet coating has chromium carbide content in the range from 35% to 60% by weight.

4. The blade according to claim 1, wherein the cermet coating has a tungsten carbide content in the range from 25% to 45% by weight.

5. The blade according to claim 1, wherein the metallic matrix of the cermet coating is in the range from 15% to 20% volume %.

6. The blade according to claim 1, wherein the metallic matrix of the cermet coating has the following composition by weight:

Co 18% to 25%
Fe 0.5% to 5%
optionally
Cr 0.1% to 10%
Ni and impurities balance.

7. The blade according to claim 1, wherein the cermet coating is applied by a thermal spraying technique.

8. The blade according to claim 1, wherein the cermet coating has a mean hardness between $HV_{0.3}$ 1200 and $HV_{0.3}$ 1400.

9. The blade according to claim 1, wherein a thickness of the cermet coating at the working edge of the blade is in the range from 120 to 300 μm.

10. The blade according to claim 9, wherein the thickness of the cermet coating at the working edge of the blade is in the range from 200 to 300 μm.

11. The blade according to claim 1, where there is no bond coat between the steel substrate and the cermet coating.

12. The blade according to claim 1, wherein the steel substrate has a pre-ground bevel, upon which the cermet coating is deposited.

13. The blade according to claim 1, wherein the steel substrate has a thickness in a range from 0.75 to 1.50 mm.

14. The blade according to claim 1, wherein the steel substrate has a width in a range from 50 to 150 mm.

15. The blade according to claim 1, wherein the cermet coating has a porosity of <1.5 volume %.

16. The blade according to claim 1, wherein the steel substrate has a thickness in a range from 0.8 to 1.30 mm.

17. The blade according to claim 1, wherein the steel substrate has a width in a range from 75 to 120 mm.

18. The blade according to claim 1, wherein the cermet coating has a porosity of <1 volume %.

* * * * *